United States Patent [19]

Corpataux

[11] Patent Number: 4,516,869

[45] Date of Patent: May 14, 1985

[54] CLIP FOR WRITING PEN OR SIMILAR OBJECT

[75] Inventor: Marcel Corpataux, Fribourg, Switzerland

[73] Assignee: USIFLAMME S.A., Villars-sur-Glane, Switzerland

[21] Appl. No.: 199,272

[22] Filed: Oct. 21, 1980

[30] Foreign Application Priority Data

Oct. 26, 1979 [FR] France ..... 79 26650

[51] Int. Cl.[3] ..... B43K 25/00

[52] U.S. Cl. ..... 401/131; 24/11 P

[58] Field of Search ..... 24/11 R, 11 M, 11 P, 24/12; 401/131, 104

[56] References Cited

U.S. PATENT DOCUMENTS

| | | | |
|---|---|---|---|
| 1,404,863 | 1/1922 | Klenck | 24/11 M |
| 1,451,261 | 4/1923 | Jallier | 24/11 P |
| 3,033,167 | 5/1962 | Spillman | 24/11 P X |
| 3,412,436 | 11/1968 | Darst | 24/11 P |

*Primary Examiner*—Edward M. Coven

*Attorney, Agent, or Firm*—Brisebois & Kruger

[57] ABSTRACT

A writing pen or similar article device has a pocket fastening clip pivoted to a body by means of a connector rigid with and outside the body. A separate leaf spring is connected to the free end of the clip and is connected to the body by means of an opening formed in a device outside of and rigid with the body. The opening is between the pivot of the clip and the free end of the clip so that the clip covers and hides the spring by virtue of a groove in the clip in which the spring is dispersed.

5 Claims, 9 Drawing Figures

CLIP FOR WRITING PEN OR SIMILAR OBJECT

The present invention relates to a writing pen or similar article with an improved clip.

By writing pen is understood any writing instrument, particularly, fountain pens, ball-point pens, graphite pens, drafting pens, felt-tipped pens or similar articles having a body and a fastening clip, rigid but movable with respect to this body. The body involved here can be constituted either of the pen itself, or for example, a removable cap.

The similar articles can be any articles comprising a clip, particularly for fastening them, for example, in a pocket of an article of clothing.

The pen clips of the known type are either retractable or pivotable, or firmly fixed to the body. In this latter case, the clip functions because of its own elasticity which presents various disadvantages. In particular, it is difficult to arrange it so that this clip is adaptable to clothing pockets of different thicknesses.

The known retractable and pivoting clips have for their part the disadvantage of including a mechanism which is often complex and fragile inside the pen. Consequently a portion of the interior space of the pen is thus rendered unavailable and cannot be used for storing ink, or accommodating a mechanism for moving the writing means in and out, as does the positioning of a seal in the case of a clip mounted on the cap of a fountain pen or a felt-tipped pen.

The present invention is designed to eliminate these disadvantages by providing a pen with a rigid clip which does not have a complex mechanism and in which moreover, all the elements can be placed outside the pen.

To this end, the present invention has as its object a pen or similar article having a body and a rigid fastening clip pivoting at one of its ends with respect to this body characterized by the fact that the clip comprises a blade spring fastened by one of its ends near the free end of the clip, the other end of the spring being connected to the body in a region near the pivoting region of the clip and spaced from this latter region in a direction toward the free end of the clip.

Advantageously, the clip is mounted to pivot around a pin mounted on a member fixed to or integral with the body.

As a variation a clip could however, be provided having an extension able to engage in an opening in the body with enough clearance to allow it to pivot.

According to one advantageous embodiment of the invention the blade spring has its other end engaged in an opening of an exterior member fixed to or integral with the body.

It is however possible to foresee a blade spring whose other end is curved and is engaged in an opening in the body.

The clip can be large and comprise a recess or groove in which the blade spring lodges, or, in another embodiment, it can be made of bent or folded sheet metal, the spring blade lodging inside the free space created by the folding.

Other characteristics and advantages of the invention will appear upon reading the following description given by way of non-limiting example of two embodiments of the invention.

The pen according to the invention shown on FIGS. 1 to 6 generally comprises a body 1 and a clip 2.

The clip 2 is mounted to pivot at its upper portion around a pin 3 borne by a projection or device 4 forming a ring which encircles the body 1 of the pen.

Figure 4:
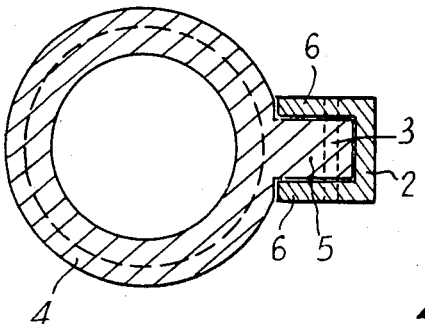
FIG. 4 is a sectional view along line IV—IV of FIG. 2.

As is shown in FIG. 4, the device 4 includes an extension 5 in which the axle pin 3 is engaged. The clip 2 comprises two wings or arms 6, provided with openings which allow it to receive the ends of the pin 3.

Moreover, another device 7 in the shape of a ring is disposed on the body 1 of the pen near device 4 and below it, that is, in an intermediate position between the two ends of the clip 2.

Figure 5:
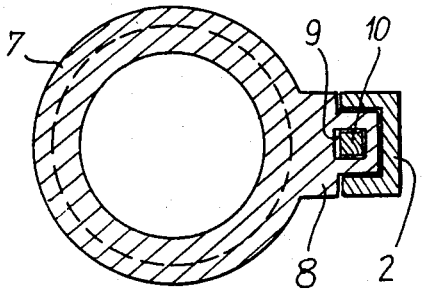
FIG. 5 is a sectional view along line V—V of FIG. 2.
Figure 6:
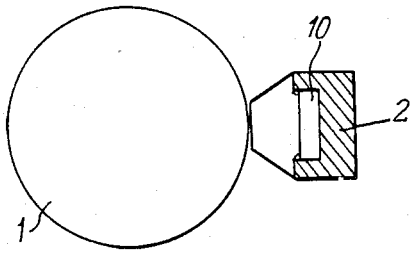
FIG. 6 is a sectional view along line VI—VI of FIG. 2.

As is shown on FIG. 5, the device 7 includes an extension 8 furnished with an opening 9.

The clip also includes a leaf or blade spring 10. The clip 2 which is solid has a groove inside of which this blade spring 10 is lodged. One of the ends of spring 10 is crimped at 11 into the interior of the cavity of clip 2 while its other end is engaged in opening 9 of device 7. A slight clearance is provided between this end of blade spring 10 and the edges of opening 9 which provides a certain pivoting movement, after which wedging occurs (FIG. 3), which limits the pivoting.

Figure 2:
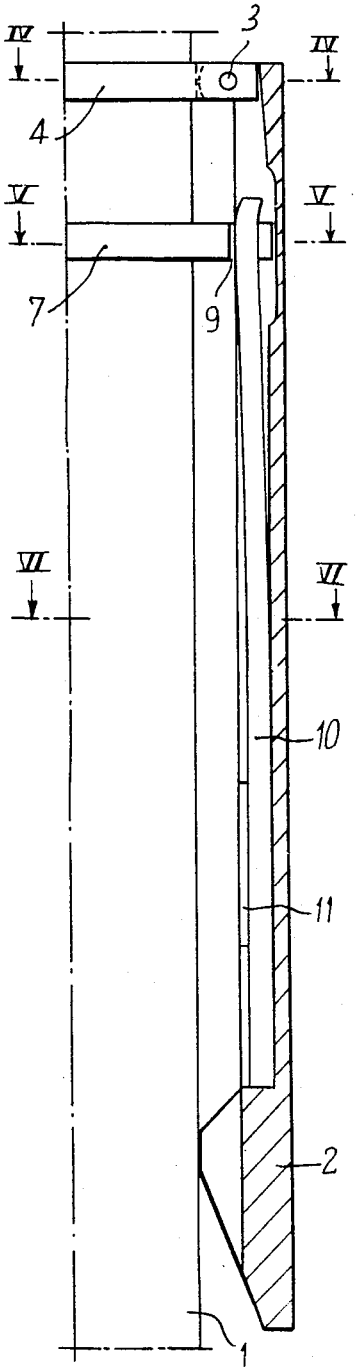
FIG. 2 is a partial axial section of the pen of FIG. 1 showing the clip in its retracted position.
Figure 3:
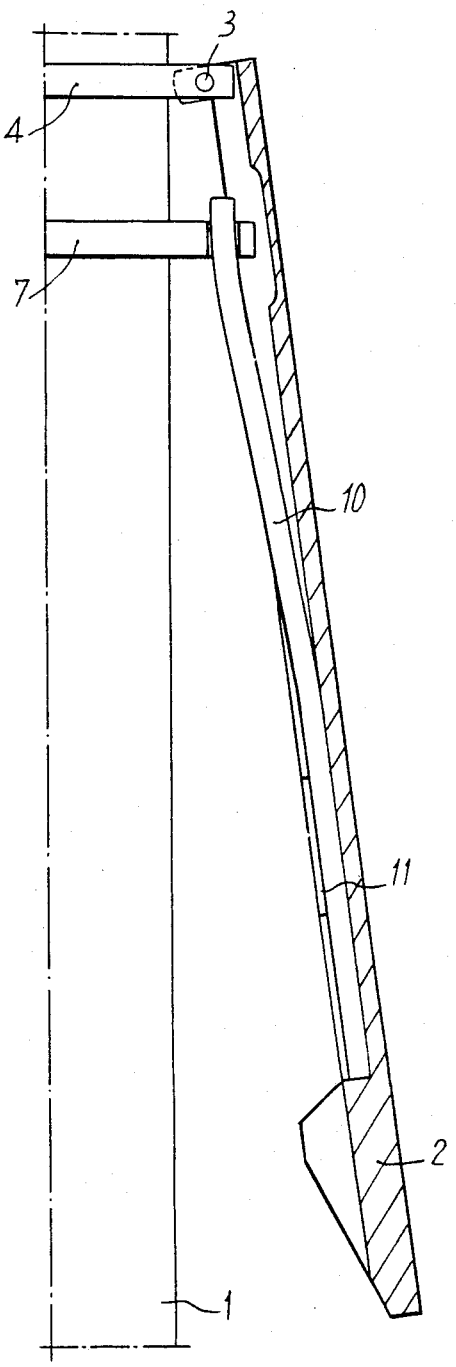
FIG. 3 is a view similar to FIG. 2 showing the clip of the pen in its position spaced from the body of the pen.
Figure 1:
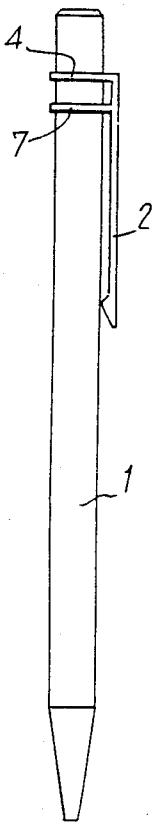
FIG. 1 is a side view of a pen according to the invention.

FIG. 3 illustrates the operation of clip 2 in the pen according to the invention.

When the lower end of clip 2 is separated from the body 1 of the pen, clip 2 pivots around pin 3 borne by device 4. During this movement, the blade spring 10, which is held on the one hand because of its crimping on clip 2, and on the other hand by its end engaged in opening 9 of device 7, is tensioned. The return force thus created tends to bring the clip 2 back into contact with body 1 of the pen so that for example if a clothing pocket is introduced between the lower end of clip 2 and body 1 of the pen it will be firmly held.

Figure 7:
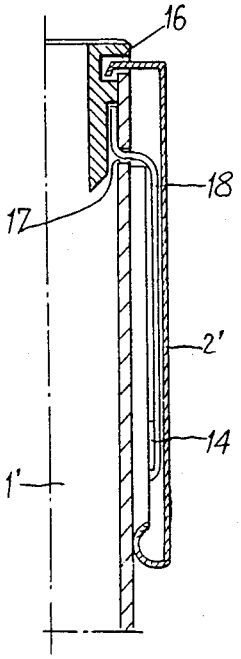
FIG. 7 is a partial axial sectional view of a pen according to another embodiment of the invention.
Figure 8:
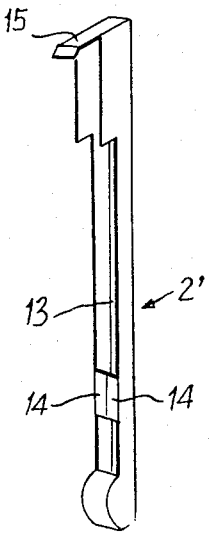
FIG. 8 is a perspective view of the clip of the pen shown at FIG. 7.
Figure 9:
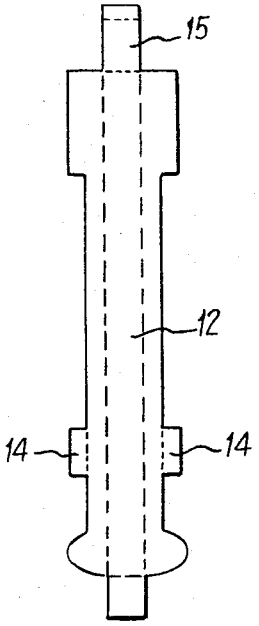
FIG. 9 is a plan view of the blank from which the clip of FIG. 8 is made.

FIGS. 7 to 9 show a variation of the pen according to the invention.

In this variation the clip 2' is no longer solid but is made from bent sheet metal the blank 12 of which is shown on FIG. 9.

As is shown on FIG. 8, the clip 2' delimits, once folded, an interior space 13 open along one of its sides with however the exception of a region closed by two small bent tongues 14.

Clip 2' also has an extension 15 whose function will be described hereafter.

Referring now to FIG. 7 it will be noted that body 1' of the pen according to the invention has in its upper portion two openings 16 and 17.

Opening 16 receives extension 15 of clip 2', sufficient clearance being provided to permit clip 2' to pivot in opening 16.

Moreover a blade spring 18 is placed in the interior space 13 of clip 2' where it is held by tongues 14. The blade spring 18 is bent at its upper portion to enter opening 17 and to then be held inside the body 1' of the pen.

As in the preceding embodiment the blade spring 18 is consequently connected to body 1' of the pen in a region between the pivoting region 16 of clip 2' and the free end of this clip.

The operation of the clip of the pen according to the invention shown on FIGS. 7 to 9 is similar to that of the clip of the pen shown on FIGS. 1 to 6.

When clip 2' is separated from body 1' of the pen, spring 18 is tensioned or stressed so that it exerts a return force tending to bring clip 2' back into contact with body 1'.

Consequently it will be noted that the invention furnishes a pen using a rigid clip while eliminating the need for any internal return mechanism. Moreover, in these two cases, the return blade spring is placed inside the clip so that it remains invisible. Moreover, while having a limited curve toward the exterior the clip allows the pen, or whatever article it is fastened to, to be fixed to a pocket of clothing whatever the thickness of the cloth of this latter.

I claim:

1. A writing pen or similar article comprising a body a rigid fastening clip extending along the outside of the body, said clip having a mounting end and a free end, means rigid with and outside said body for pivotally connecting said mounting end of said clip to said body for pivotal movement about an axis, a leaf spring for urging said clip toward said body, said spring having a first end secured to said fastening clip near the free end of the clip, and a second end spaced from the first end, and means rigid with and outside said body and having an opening near said axis and between said axis and the free end of said clip, for receiving said second end of said leaf spring to connect said second end to said body, said opening being slightly greater than the second end of said leaf spring.

2. A writing pen according to claim 1 wherein said means for pivotally connecting said clip to said body comprises a ring encircling the body and a pin connecting the clip to the ring.

3. A writing pen according to claim 2 wherein said opening comprises means to permit slight pivoting movement of the second end of the spring.

4. A writing pen according to claims 1, 2, or 3, wherein said clip comprises a solid clip having an elongated groove, and said spring comprises an elongated spring within said groove.

5. A writing pen according to claim 1, wherein said clip comprises a clip formed from sheet metal and having sides bent from the metal of the clip to form a groove, said leaf spring comprises a leaf spring within said groove, and at least one tab bent across said groove to retain said spring in the groove.

* * * * *